US005086634A

United States Patent [19]

Richards

[11] Patent Number: 5,086,634

[45] Date of Patent: Feb. 11, 1992

[54] COIL-TO-COIL STEEL SLITTING PROCESS

[75] Inventor: Lawrence J. Richards, Naperville, Ill.

[73] Assignee: Braner, Inc., Schiller Park, Ill.

[21] Appl. No.: 618,074

[22] Filed: Nov. 26, 1990

[51] Int. Cl.[5] ..... B21B 15/00

[52] U.S. Cl. ..... 72/161; 72/203; 72/377; 242/56.1

[58] Field of Search ..... 72/160, 161, 163, 203, 72/206, 129, 130, 132, 377; 242/56.1, 56.2, 56.3, 56.7, 56.9

[56] References Cited

U.S. PATENT DOCUMENTS 2,120,473 6/1938 Sheperdson ..... 242/56.4
2,216,869 10/1940 Yoder et al. ..... 72/203
4,347,723 9/1982 Bradlee ..... 72/203
4,558,578 12/1985 Noé ..... 72/161
4,614,101 9/1986 Fornataro ..... 72/203
4,651,549 3/1987 Masui ..... 72/161
4,866,967 9/1989 Sporenberg et al. ..... 72/160

*Primary Examiner*—Lowell A. Larson
*Assistant Examiner*—Thomas C. Schoeffler
*Attorney, Agent, or Firm*—Thomas J. Dodd

[57] ABSTRACT

A process for slitting and recoiling steel which includes first levelling the uncoiled steel to elongate the steel at its thickest point. The levelled steel sheet is then slit into multiple strands, rolled and recoiled.

1 Claim, 2 Drawing Sheets

COIL-TO-COIL STEEL SLITTING PROCESS

FIELD OF THE INVENTION

This invention relates to coiled steel processing and will have application to a single line coil slitting and rolling process.

BACKGROUND OF THE INVENTION

In the metal processing industry, strips of metal are passed through coil to coil rolling lines to enhance the thickness tolerence and the flatness of the metal.

Small diameter work rolls are employed on the rolling machines to reduce thickness and large diameter are used for flatness corrections.

It is necessary for the strip to be subjected to tension less than the yield point in order to keep the point of slip as far ahead of the roll centerline as possible.

The coils of metal to be rolled are usually slit to a specified width prior to rolling but in some cases the slitting may be performed after rolling.

This slitting operation is carried out on a coil to coil type line.

When coils of metal are slit, a problem occurs due to the crown or thickness variation in the mother coil. As slit strips of different thicknesses wind up on a recoiler, the individual coils wind up at different diameters, which causes a slack or loose condition on some of the strips.

Different methods have been devised to overcome this slack loop problem ranging from the insertion of a paper filler material in the loose strips to accumulation pits and tensioning devices between the slitter and recoiler. One method discussed in U.S. Pat. No. 4,614,101 inserts a levelling device between a slitter and recoiler.

These teachings and operations are well known by those skilled in this art.

SUMMARY OF THE INVENTION

The process of this invention includes passing the uncoiled metal through a levelling device having offset rolls that can be bent anywhere along the axis. This would effectively elongate the metal sheet at its thickest point to insure equal tension on all slit strips.

After slitting, the metal strips are passed through a rolling device for thickness and flatness enhancement. By elongating and deforming the metal prior to slitting, equal tension can be applied to all strands which will move the point of slip ahead of the rolling machine. This promotes efficient slitting and rolling to thickness and also eliminates the need for a pit and/or a separate tensioning device.

Accordingly, it is an object of this invention to provide for a single line coil-to-coil steel slitting process.

Another object is to provide for a single line metal slitting process which produces tight coils of uniform metal thickness.

Other objects will become apparent upon a reading of the following description.

BRIEF DESCRIPTION OF THE DRAWINGS

A preferred embodiment of the invention has been depicted for illustrative purposes wherein.

DESCRIPTION OF THE PREFERRED EMBODIMENT

Figure 1:
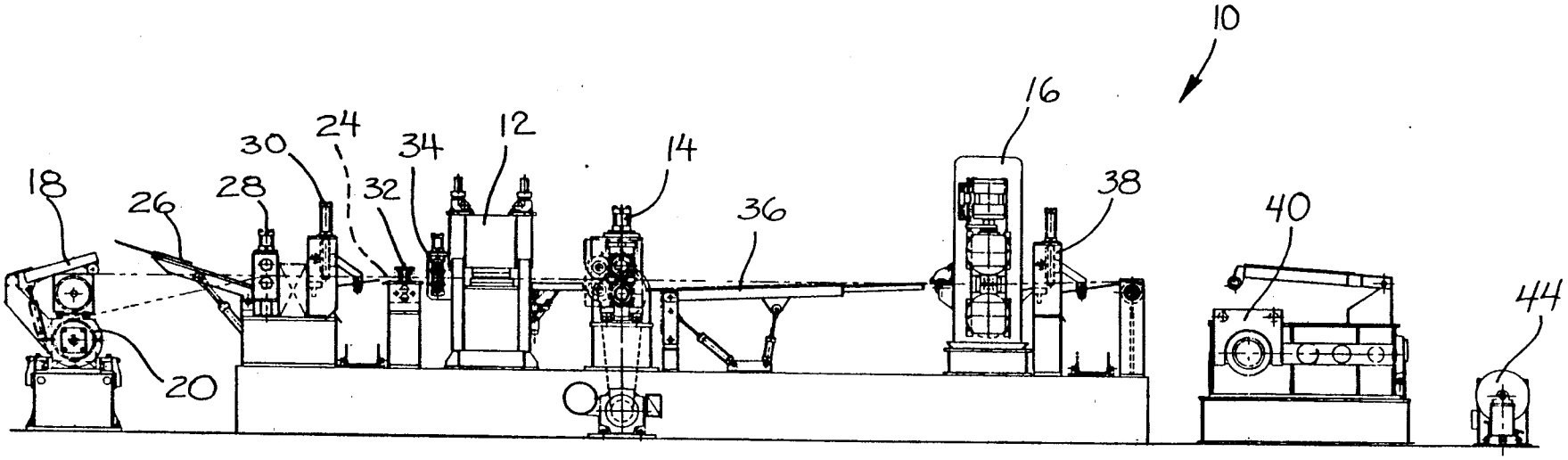
FIG. 1 is an elevation view of the machinery used in the single line steel slitting process of this invention.
Figure 2:
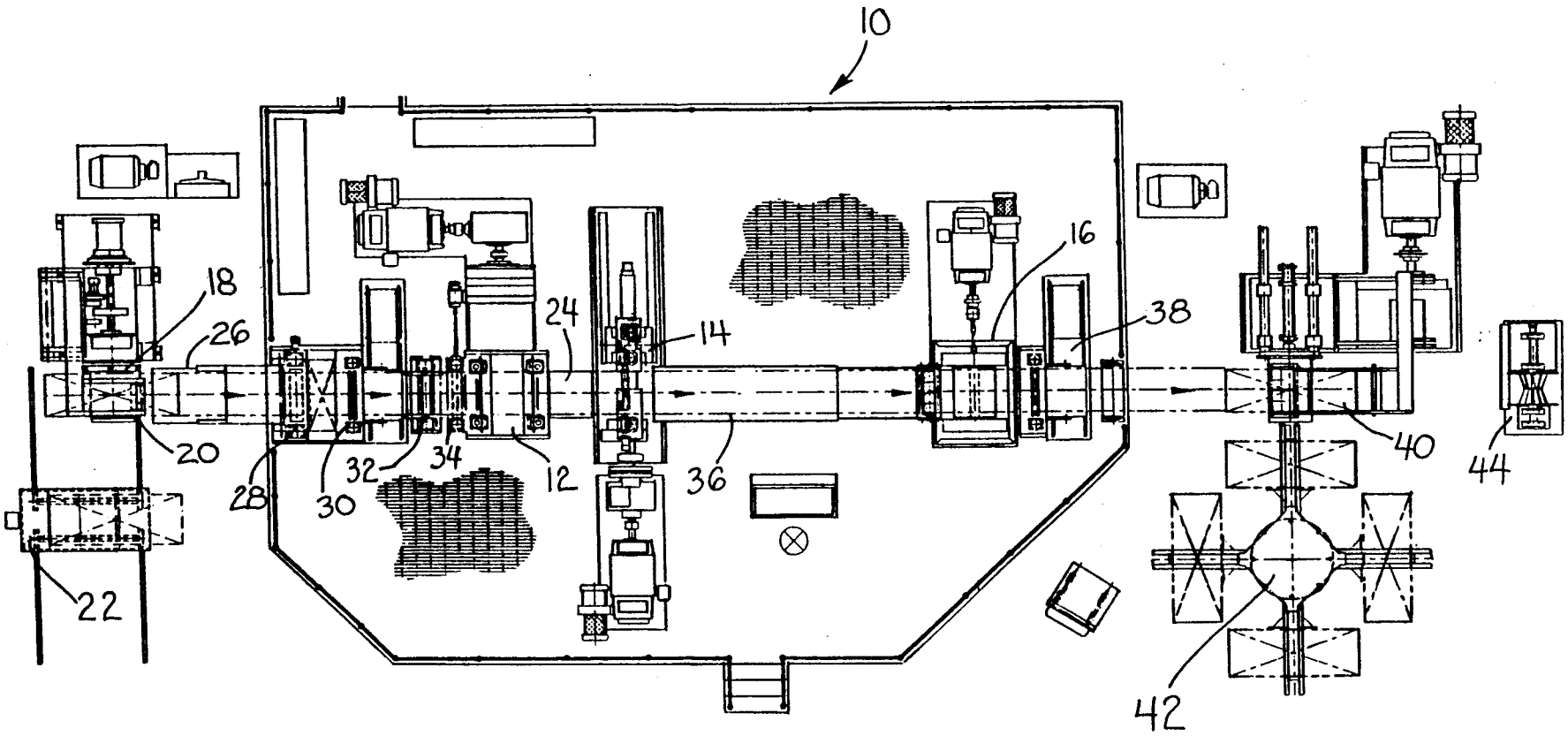
FIG. 2 is a top plan view of the slitting line of FIG. 1.

The preferred embodiment and process herein described is not to be considered exhaustive or limited to the machinery and steps disclosed. It is intended to be illustrative of the invention to disclose to others skilled in the art the teachings of the process.

Referring now to the drawings, reference numeral 10 generally refers to a steel slitting line which includes machinery to perform the process which is the subject of this invention. Although the drawings depict a complete processing line, this invention is concerned only with the process which takes place between leveller 12, slitter 14 and rolling mill 16, which is the only part of line 10 which will be described in detail.

Slitting line 10 begins at uncoiler 18 where a coil of steel 20 is rotatably secured after removal from coil car 22. As the steel is uncoiled, it is passed in the flat sheet form 24 through a peeler blade 26, pinch rolls 28, crop shear 30, guides 32 and pinch rolls 34 into leveller 12.

Leveller 12 includes a plurality of offset rolls as shown in U.S. Pat. No. 4,614,101, incorporated herein by reference, which rolls serve to elongate sheet 24 at its thickest point, normally its center.

Sheet 24 is then passed through slitter 14 where it is slit into multiple strands of predetermined widths. Slitter 14 may be any one of the numerous commercially available slitters, whose teachings and operations are well known by those skilled in this art.

After sheet 24 has been passed through slitter 14, it is passed across thread table 36 to rolling mill 16 which may be of any acceptable commercially available construction. For purposes of disclosure, the rolling mill 16 used in this description, includes five inch diameter work rolls and twenty-four inch diameter back-up rolls. Rolling mill 16 serves to roll the slit steel to a desired finish thickness as is common in the art.

After rolling, the sheet 24, now in rolled strands, is passed through crop shear 38 and recoiled at recoiler 40. After recoiling, the multiple coils are transferred to storage horn 42 for loading onto a delivery truck or other vehicle (not shown). Scrap recoiler 44 recoils any edge scrap pats from the steel sheet 14 after it has passed through rolling mill 16.

The process as above described is the first to provide for equal tensioning across the width of steel sheet 24 from the moment it is uncoiled until it is recoiled for eventual shipment. The exact nature of the machinery used is not critical to this feature of the process only the locations of the leveller 12, slitter 14, and rolling mill 16. The process is limited only within the scope of the following claim.

I claim:

1. A single line process for slitting uncoiled steel and then recoiling slit steel into uniform thickness coils comprising the steps of:

a) uncoiling a single sheet of steel of varying thickness from edge to edge; then b) passing said steel sheet through a machine which elongates said sheet of steel at its thickest point; then c) passing said steel sheet through a machine which slits the steel sheet into multiple strands; then d) passing said multiple strands of steel through a machine which rolls the multiple strands to a desired finish thickness; then e) recoiling said steel into a multiplicity of individual uniform thickness coils on a single recoiler.

* * * * *